US005601355A

United States Patent [19]

Valentino

[11] Patent Number: 5,601,355

[45] Date of Patent: Feb. 11, 1997

[54] DEVICE FOR ROTATING A LAMP FINIAL

[76] Inventor: George Valentino, 2667 Roackaway Ave., Oceanside, N.Y. 11572

[21] Appl. No.: 537,471

[22] Filed: Oct. 2, 1995

[51] Int. Cl.[6] ..... F21V 21/30

[52] U.S. Cl. ..... 362/35; 362/276; 362/806; 362/411; 362/802; 40/414; 40/430

[58] Field of Search ..... 362/35, 806, 808, 362/253, 431, 276, 802, 410, 411, 412; 40/431, 414, 415, 429, 430, 423

[56] References Cited

U.S. PATENT DOCUMENTS

| | | | |
|---|---|---|---|
| 2,092,520 | 9/1937 | Nielsen | 362/124 |
| 2,506,295 | 5/1950 | Elvan et al. | 362/124 |
| 3,681,589 | 8/1972 | Roberts | 362/253 |
| 5,003,441 | 3/1991 | Crowe et al. | 362/183 |
| 5,029,047 | 7/1991 | Kachel | 362/807 |
| 5,097,398 | 3/1992 | Dye | 362/124 |
| 5,277,948 | 1/1994 | Daun | 40/414 |
| 5,491,616 | 2/1996 | Reed | 362/806 |

*Primary Examiner*—Ira S. Iazarus
*Assistant Examiner*—Thomas M. Sember
*Attorney, Agent, or Firm*—Grimes & Battersby

[57] ABSTRACT

A device for rotating a finial attached to a table lamp is provided with an adaptor for providing household current directly from the lamp at a reduced voltage to the drive motor of the device. Preferably, the device includes a battery pack so that a drive shaft of the device which is connectable to a finial can be rotated by either battery power or through a transformer.

13 Claims, 4 Drawing Sheets

DEVICE FOR ROTATING A LAMP FINIAL

BACKGROUND OF THE INVENTION

The present invention relates generally to a device adapted to cause a lamp finial to rotate about a lamp and, more particularly, to such a device that is electrically powered using either an internal battery pack or, alternatively, derives power from the electric current used to power the lamp through an adaptor.

Table lamps of the type having lampshades have long used finials to secure the lampshade to the harp of the lamp. Typically, the harps of such lamps include an upstanding male member to which the frame of the lampshade is attached. A finial is threadably attached to the male member to secure the lampshade to the harp of the lamp. While, heretofore, most finials have been plain, there has been a recent trend toward decorating or adorning such finials. Recently, more decorative finials have been used which include, for example, cartoon characters or other superheroes. This is particularly true when the lamp is intended to be used in a child's room. For example, a well-known and favorite character of a child can be designed as the finial or a holiday figure such as a Santa Claus figure can be designed as the finial to decorate the lamp during the holiday season.

Such decorated finials are nomeally three-dimensional in shape and affixed to the top of the lamp. As such, unless the decorative finial can be observed from all sides, the full impact of its aesthetic effect is lost. In order to see the front, side and back views of the decorative final, a person must either walk around the entire lamp or the lamp must be able to be rotated. Thus, while the manufacturer of such decorated finials may have spent a great deal of time, effort and expense in sculpturing subtle details on every part of the decorative finial, the end user fails to appreciate all of the details incorporated in such item.

This current limitation can be remedied by having the decorative finial rotate slowly relative to the lamp while still performing the principal objective of attaching the lampshade to the lamp. This may be accomplished by providing an independent power source, e.g., a battery powered motor, or, alternatively, using the electrical power from the lamp itself.

Applicant is unaware of any device that accomplishes such a task, namely the rotation of a finial for a lamp by the use of either an independent power source or using power derived from the lamp.

SUMMARY OF THE INVENTION

Against the foregoing background, it is a primary object of the present invention to provide a device which can be attached simply to existing table lamps to permit the rotation of the finial about the lamp to enhance its decorative effect.

It is another object of the present invention is to provide such a device that is powered by an independent power source such as, for example, a battery.

It is yet another object of the present invention to provide such a device that is powered by electricity from the lamp using an adaptor that can be threaded into an existing lamp socket to provide a reduced voltage to power the device.

It is still yet another object of the present invention to provide such a device which includes means to automatically coordinate the rotation of the finial with the operation of the lamp.

To the accomplishments of the foregoing objects and advantages, the present invention, in brief summary, comprises a device for rotating a decorative finial of a lamp which includes a base adapted to be affixed adjacent the top portion of the lamp. A shaft extends upwardly from the base to an end fitting within a decorative finial. The drive shaft is rotated preferably by a D.C. motor and a reduction gear train that connects the D.C. motor to the shaft. The drive shaft may be powered by either a battery pack that provides energizing power to the D.C. motor or, alternatively, power derived from the lamp. A photoelectric element may be connected in series with the power source and the D.C. motor. In this way, power to the motor can be interrupted when light is not impinging on the photoelectric element, i.e., when the lamp is turned off, resulting in the device ceasing to rotate.

Additionally, a switch may be provided for interrupting energizing power from the battery pack to the motor and a transformer having a jack adapted to open the switch is provided so energizing power to the D.C. motor can be provided directly by the transformer. The transformer is provided by an adaptor which includes a housing having at one end portion a conductive male member adapted to be threaded into the conductive lamp socket, and a transformer for reducing voltage from the male member to an outlet. A socket is also provided for a light bulb and is connected electrically to the end portion of the adaptor for delivering household current to the light bulb. In this way, the adaptor can be threaded into the normal lamp socket where the light bulb would ordinarily be received; and can provide reduced voltage for rotating the finial while also providing direct household current to a light bulb.

These and other objects, advantages, and features of the present invention will become more apparent upon review of the descriptions made below in connection with illustrated embodiments of the present invention.

BRIEF DESCRIPTION OF THE DRAWINGS

The foregoing and still other objects and advantages of the present invention will be more apparent from the detailed explanation of the preferred embodiments of the invention in connection with the accompanying drawing, wherein.

DETAILED DESCRIPTION OF THE INVENTION

Figure 1:
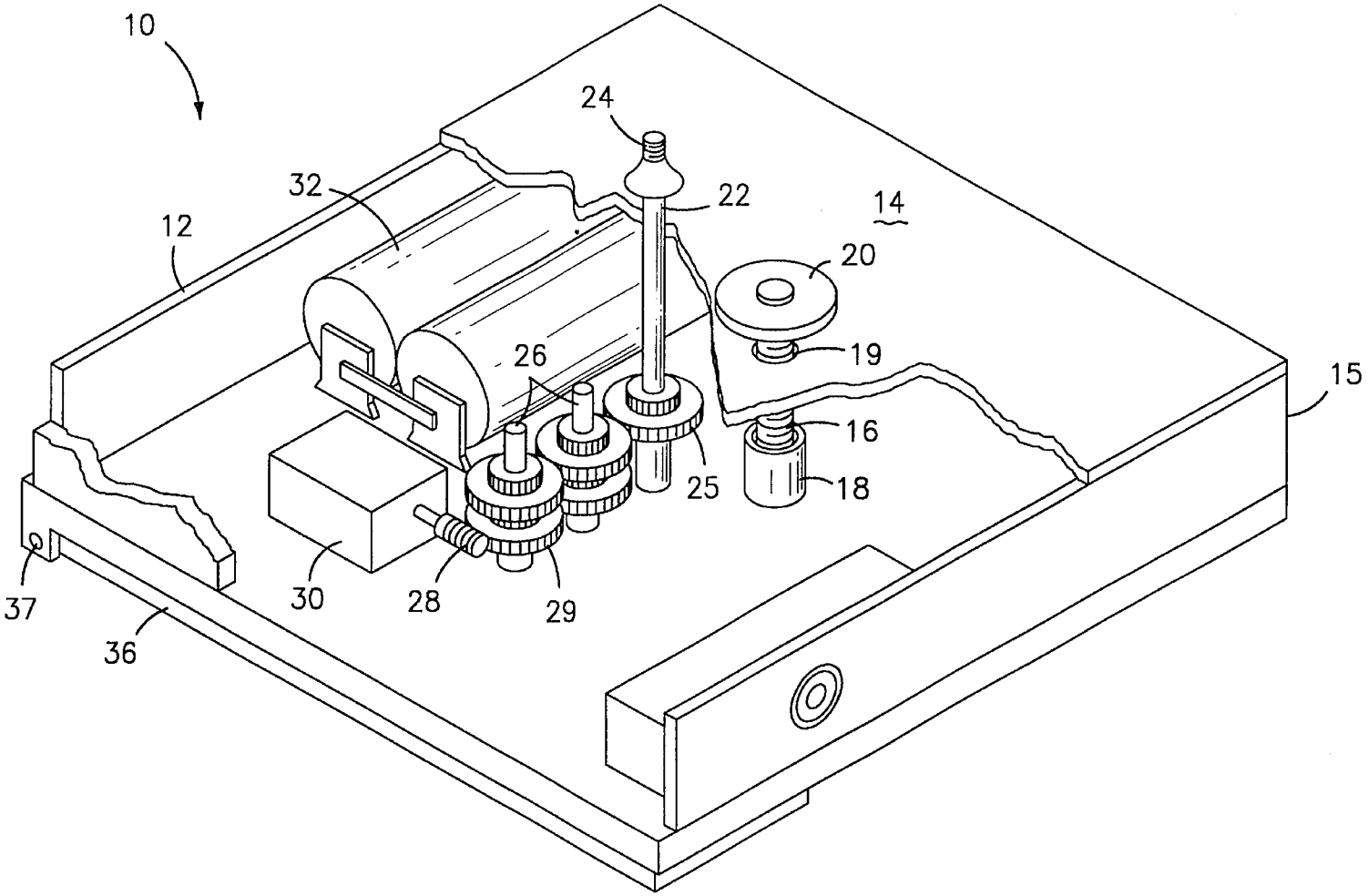
FIG. 1 is an exploded perspective view of the finial rotating device of the present invention.

As illustrated in FIG. 1, the device of the present invention for rotating the finial of a lamp is referred to generally by reference numeral 10. Device 10 includes a base 12 having a top wall 14 to form a housing 15.

Figure 3:
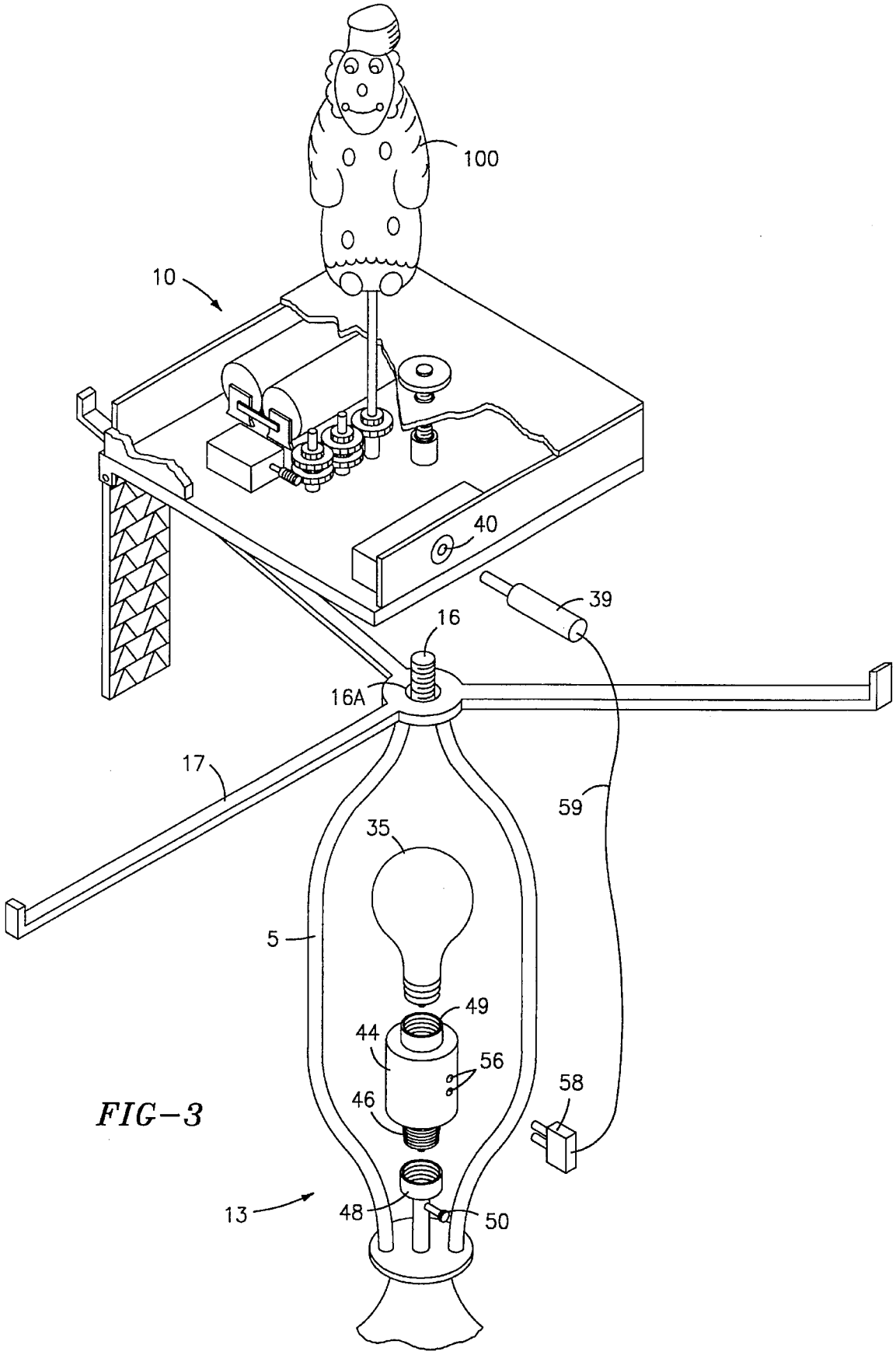
FIG. 3 is a perspective view of the device of FIG. 2 mounted on a lamp base and further illustrating the use of an electrical adaptor for powering the device.

As shown in greater detail in FIG. 3, the device 10 is adapted to be mounted on the harp 5 of a lamp 13. Harp 5 has an upstanding male member 16 which is adapted to pass through an aperture 16A contained in the center portion of the frame 17 of a lamp shade (not shown). The male member 16 of the harp 5 may be secured to the frame 17 by the use of a thumb nut 20 which is threadably secured to the male member 16.

The device 10 of the present invention is adapted to be mounted on the upstanding male member 16 of the harp 5 with the male member 16 received within a central conduit 18 leading to an opening 19 in the top wall 14 of the base 12. The male member 16 is adapted to extend through the top wall 14 of the housing 15 and is engaged by a thumb nut 20 or the like to secure the base 12 of the device 10 directly to the upstanding male member 16.

Located within the base 12 is an upstanding drive shaft 22 having mounted on its top portion a connector 24 adapted to threadably engage a decorative finial 100. As can be understood in the art, the decorative finial can take any desired form including a licensed character for children, or a seasonable figurine. By rotation of the drive shaft 22 as a result of the device 10, the final 100 will be continuously rotated relative to the device 10 and the lamp.

The drive shaft 22 is connected to a drive gear 25 connected through reduction gears 26 providing a gear train connected to the output worm drive 28 of D.C. motor 30. The use of the reduction gears 26 is required due to the high RPM's associated with such D.C. motors to prevent the finial from rotating too rapidly. Worm drive 28 is connected to spur gear 29 in a self locking manner. Connected electrically to the D.C. motor 30 are batteries 32 which, preferably, are each of 1.5 v.

As can be understood in the art, the base 12 can be connected to the upstanding male member 16 of a lamp and held securely thereto by means of thumb nut 20. The finial can be connected to connector 24 connected to upstanding drive shaft 22. In this way, energizing the D.C. motor 30 will allow the finial to rotate; and disconnecting energizing power to the motor 30 will result in the finial ending rotation as a result of the self-locking arrangement between the worm drive 28 and the spur gear 29.

Figure 2:
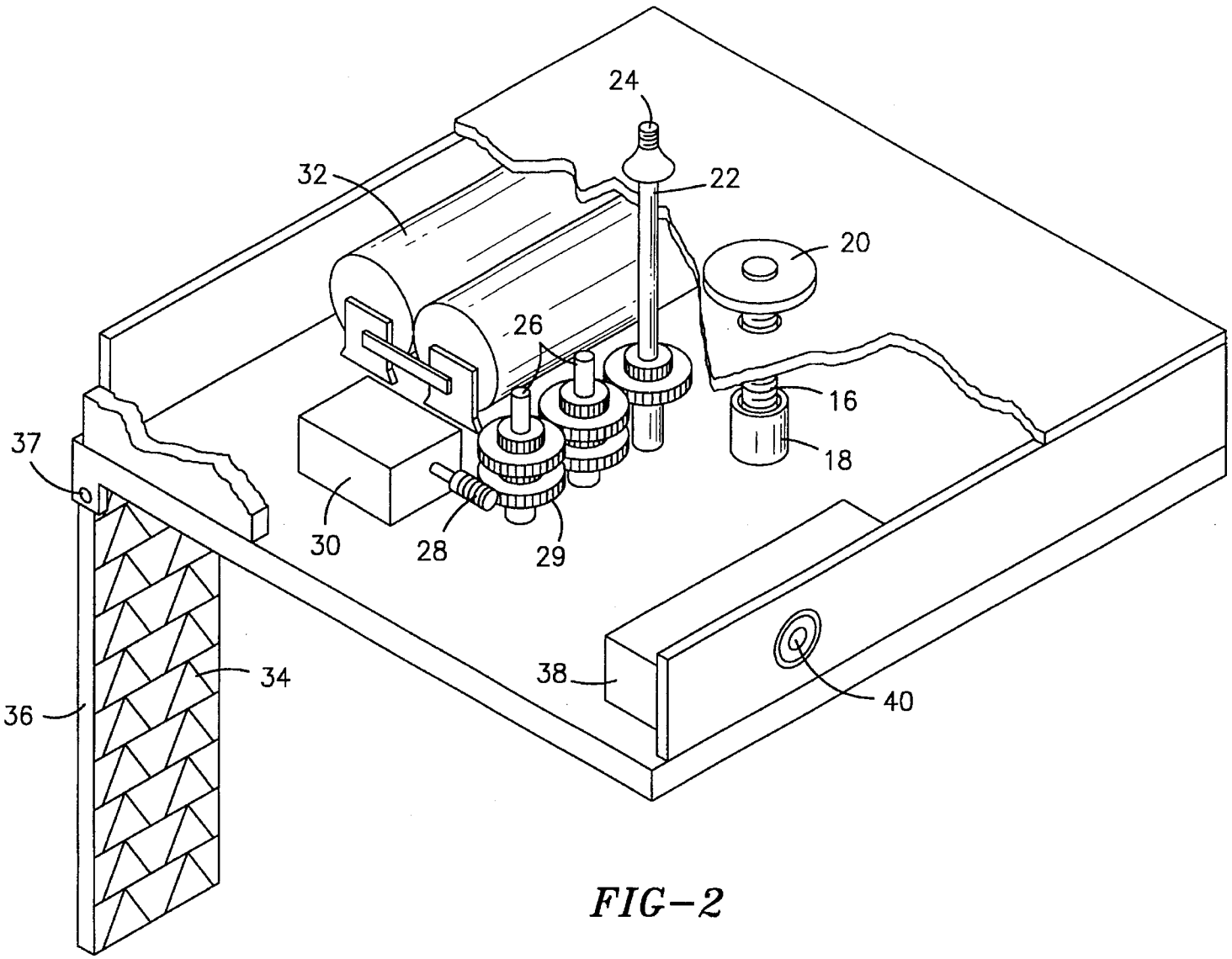
FIG. 2 is a perspective view of the device of FIG. 1 incorporating a photoelectric element.

In a preferred embodiment illustrated in FIG. 2, the device 10 can be controlled to coordinate with the lamp, e.g., the device 10 can be actuated when the lamp is turned on. To accomplish this, a photoelectric element 34 is provided with a carrier 36 pivoted at 37 to the lower portion of the base 12. In the position shown in FIG. 1 the carrier 36 is pivoted upwardly to protect the photoelectric element 34. In the position of FIG. 2, the photoelectric element 34 is exposed to ambient light. The photoelectric element 34 is connected electrically in series between the battery pack 32 and the D.C. motor 30 and it is designed so that when ambient light is not impinging on the photoelectric element 34, the series connection between the D.C. motor and the battery pack is open so that the finial will not be rotated. However, in the position shown in FIG. 2, when sufficient ambient light impinges upon the photoelectric element 34, such as turning on the light bulb 35 illustrated in FIG. 3, the finial will be caused to rotate. In this way, the photoelectric element can be adjusted so that activation of the light bulb 35 can be made to control rotation of the finial. Thus, the photoelectric element 34 serves, in effect, as an "on/off" switch for the device 10 as well as contributing slightly to the input voltage.

Additionally, a switch 38 can be provided which is normally closed and placed in series with the electric circuit containing the battery pack and the D.C. motor. A transformer for providing 1.5 volts from household current can be provided and a jack 39 as illustrated in FIG. 3, can be inserted within opening 40 to shunt the D.C. batteries out of the energizing circuit to the motor and provide current directly from the transformer. As is well understood in the art, appropriate rectifying elements would be provided in the switch 38 to provide the appropriate current to the D.C. motor.

Additionally, as can be understood in the art, an electrical connection can be made between the connector 24 for the finial and the power supply so that energizing current can be directed to the finial in the event the finial includes an illuminating element.

Figure 4:
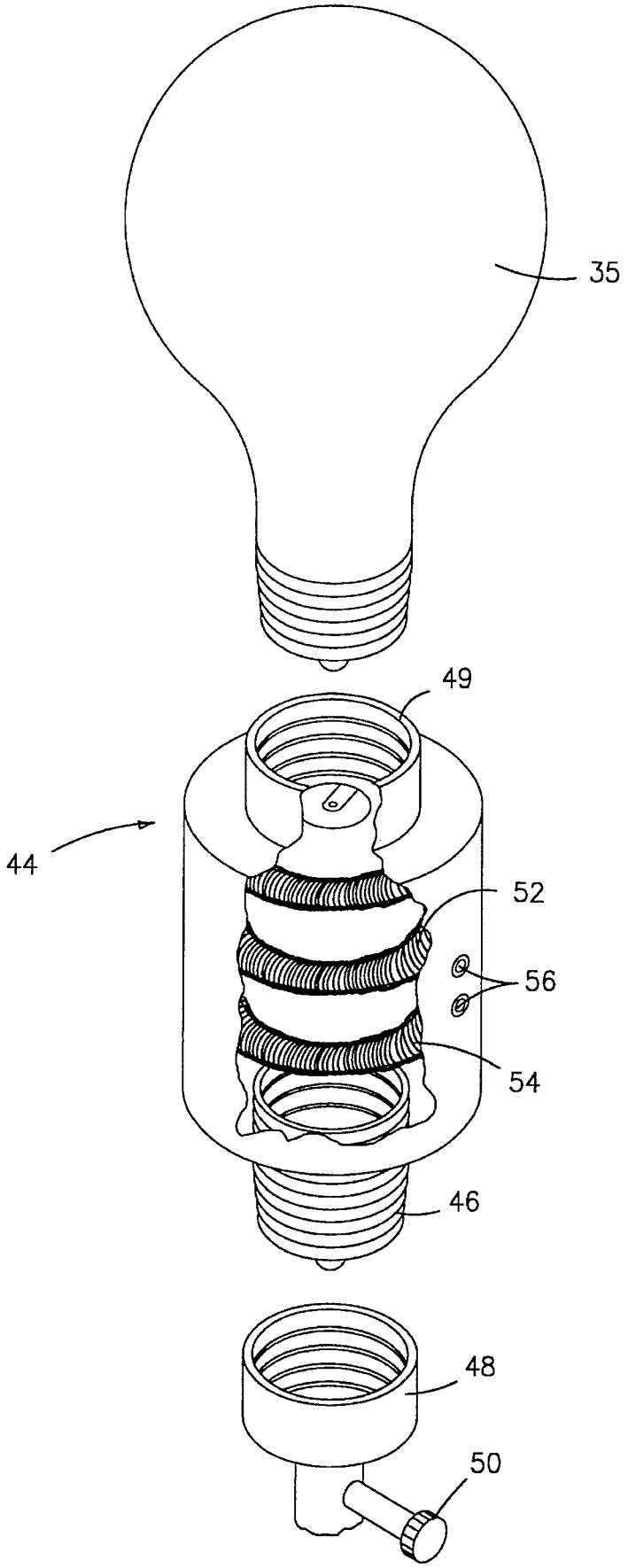
FIG. 4 is an exploded perspective view of the adaptor of the present invention.

As illustrated in FIGS. 3 and 4, the device 10 can be connected to the upstanding male member 16 of the lamp to secure the finial for rotation. Additionally, an adaptor 44 can be provided to provide direct energizing current to power the device 10 in lieu of a battery pack. The adaptor 44 includes a conductive male socket 46 which can be threaded within the bulb socket 48 of a lamp; and includes a bulb socket 49 which is connected electrically to the male socket 46. In this way, the light bulb 35 can be threaded into the bulb socket 49 and connected electrically directly to the male socket 48 so that when the on/off switch 50 of the lamp is activated, the light bulb can be illuminated.

The adaptor 44 additionally includes a secondary winding 52 and a primary winding 54 to step-down the household voltage received at the lamp socket 48; and the step-down voltage is provided at outputs 56. A jack 58 is provided for inserting into the outputs 56 and is connected through cord 59 to the jack 39 insertable in the opening 40. In this way, current directly from the lamp 13 can be provided to the device for rotating a finial so as to conserve battery power.

Having thus described the invention with particular reference to the preferred forms thereof, it will be obvious that various changes and modifications can be made therein without departing from the spirit and scope of the present invention as defined by the appended claims.

What is claimed is:

1. A device for rotating a decorative finial about a lamp of the type having a lamp socket connected to an external source of household electrical current and a light bulb, said device including:

a housing;

means for securing said housing to said lamp;

means for mounting said decorative finial on said housing; and means for rotating said decorative finial relative to said housing, said means for rotating including:

a power source;

a D.C. motor mounted on said housing and connected to said power source;

a drive shaft connected between said D.C. motor and said decorative finial; and a photoelectric element connected between said power source and said D.C. motor and positioned adjacent to the light bulb, said photoelectric element adapted to interrupt the flow of power to the D.C. motor upon sensing the absence of light emanating from said light bulb to thereby prevent rotation of the decorative finial.

2. The device of claim 1, wherein said power source is a battery pack.

3. The device of claim 1, wherein said power source includes:

an adaptor which can be threaded into the lamp socket of the lamp for receiving the household electrical current from said lamp socket;

a transformer for reducing the voltage of the household electrical current;

first connecting means for electrically connecting said adaptor to said transformer; and second connecting means for electrically connecting said transformer to said D.C. motor.

4. The device of claim 3, wherein said adaptor further includes a receiving socket for receiving said light bulb.

5. The device of claim 1, wherein said mounting means comprises a recess within said housing adapted to receive and engage a male element provided on a harp attached to said lamp.

6. The device of claim 1, wherein said means for rotating further includes an on/off switch for controlling the operation of the D.C. motor.

7. A device for rotating a decorative finial about a lamp of the type having a lamp socket connected to an external source of household electrical current and a light bulb, said device including:

a housing;

means for securing said housing to said lamp;

means for mounting said decorative finial on said housing; and means for rotating said decorative finial relative to said housing, said means for rotating including:

a D.C. motor mounted on said housing;

a drive shaft connecting said D.C. motor and said decorative finial; and a power source connected to said D.C. motor, said power source including:

an adaptor which can be threaded into the lamp socket of the lamp for receiving the household electrical current from said lamp socket;

a transformer for reducing the voltage of the household electrical current;

first connecting means for electrically connecting said adaptor to said transformer; and second connecting means for electrically connecting said transformer to said D.C. motor.

8. The device of claim 7, further including a photoelectric element connected between said power source and said D.C. motor and positioned adjacent to said light bulb, said photoelectric element adapted to interrupt the flow of power to said D.C. motor upon sensing the absence of light emanating from said light bulb to thereby prevent rotation of said decorative finial.

9. The device of claim 7, wherein said adaptor further includes a receiving socket for receiving said light bulb.

10. The device of claim 7, wherein said mounting means comprises a recess within said housing adapted to receive and engage a male element provided on a harp attached to said lamp.

11. The device of claim 7, wherein said means for rotating further includes an on/off switch for controlling the operation of said D.C. motor.

12. A lamp of the type having a lamp socket connected to an external source of household electrical current and a light bulb, said lamp having a decorative finial and a device for rotating said decorative finial, said device for rotating said decorative finial including:

a housing;

means for securing said housing to said lamp;

means for mounting said decorative finial on said housing; and means for rotating said decorative finial relative to said housing, said means for rotating including:

a power source;

a D.C. motor mounted on said housing and connected to said power source;

a drive shaft connected between said D.C. motor and said decorative finial; and a photoelectric element connected between said power source and said D.C. motor and positioned adjacent to said light bulb, said photoelectric element adapted to interrupt the flow of power to said D.C. motor upon sensing the absence of light emanating from said light bulb to thereby prevent rotation of said decorative finial.

13. A lamp of the type having a lamp socket connected to an external source of household electrical current and a light bulb, said lamp having a decorative finial and a device for rotating said decorative finial, said device for rotating said decorative finial including:

a housing;

means for securing said housing to said lamp;

means for mounting said decorative finial on said housing; and means for rotating said decorative finial relative to said housing, said means for rotating including:

a D.C. motor mounted on said housing;

a drive shaft connecting said D.C. motor and said decorative finial; and a power source connected to said D.C. motor, said power source including:

an adaptor which can be threaded into said lamp socket of said lamp for receiving the household electrical current from said lamp socket;

a transformer for reducing the voltage of the household electrical current;

first connecting means for electrically connecting said adaptor to said transformer; and second connecting means for electrically connecting said transformer to said D.C. motor.

* * * * *